US006257790B1

(12) United States Patent
Toder

(10) Patent No.: US 6,257,790 B1
(45) Date of Patent: Jul. 10, 2001

(54) CONTAINER FOR STORING AND DISPLAYING A SOAP SYSTEM

(76) Inventor: Ellis I. Toder, 2000 Pioneer Rd., Huntingdon Valley, PA (US) 19006

( * ) Notice: Subject to any disclaimer, the term of this patent is extended or adjusted under 35 U.S.C. 154(b) by 0 days.

(21) Appl. No.: 09/752,569

(22) Filed: Dec. 29, 2000

Related U.S. Application Data

(63) Continuation-in-part of application No. 09/543,137, filed on Apr. 5, 2000.

(51) Int. Cl.[7] ..... A47K 7/02

(52) U.S. Cl. ..... 401/201; 401/131; 206/77.1; 206/493

(58) Field of Search ..... 401/201, 88, 131; 206/77.1, 204, 493; 215/227

(56) References Cited

U.S. PATENT DOCUMENTS

| | | | | |
|---|---|---|---|---|
| 684,234 | | 10/1901 | Haywood . | |
| 835,673 | | 11/1906 | Fross . | |
| 1,445,835 | | 2/1923 | Hooper . | |
| 1,795,417 | | 3/1931 | Allen . | |
| 2,064,594 | | 12/1936 | Dickey . | |
| 2,132,734 | | 10/1938 | Hart et al. . | |
| 2,163,324 | | 6/1939 | Reinhold . | |
| 2,390,423 | | 12/1945 | Carter . | |
| 2,460,963 | | 2/1949 | Young . | |
| 2,598,334 | | 5/1952 | Ahlburg . | |
| 2,602,482 | | 7/1952 | Lyon . | |
| 2,607,940 | | 8/1952 | Miller . | |
| 2,678,672 | | 5/1954 | Spilman . | |
| 4,098,405 | | 7/1978 | Botvin . | |
| 4,189,808 | | 2/1980 | Brown . | |
| 4,228,834 | | 10/1980 | Desnick . | |
| 4,605,127 | * | 8/1986 | Magnussen, Jr. | 206/493 |
| 4,697,312 | | 10/1987 | Freyer . | |
| 4,938,346 | * | 7/1990 | Urbano | 206/77.1 |
| 4,979,833 | | 12/1990 | Cook . | |
| 5,031,759 | | 7/1991 | Ogilvie . | |
| 5,207,725 | | 5/1993 | Pinkerton . | |
| 5,238,305 | | 8/1993 | Feller . | |
| 5,316,139 | * | 5/1994 | Judd et al. | 206/493 |
| 5,509,529 | * | 4/1996 | Kelley | 206/77.1 |
| 5,857,794 | | 1/1999 | Chien . | |
| 5,894,612 | * | 4/1999 | Wilson | 206/77.1 |
| 6,047,821 | * | 4/2000 | Hashimoto et al. | 206/493 |

* cited by examiner

*Primary Examiner*—David J. Walczak
(74) *Attorney, Agent, or Firm*—Caesar, Rivise, Bernstein, Cohen & Pokotilow, Ltd.

(57) ABSTRACT

A container for storing and displaying a soap system. The soap system includes a bar of soap, a flexible, porous sheet retained around the bar of soap and a sliding fastener. The sliding fastener includes a peripheral wall that defines a central passageway therethrough. The sliding fastener is arranged for engaging a gathered end of the sheet extending through the central passageway thereof to retain the sheet about the bar of soap in a taut condition. The container includes a cover member arranged to fit together with a tray member. The cover member includes at least a top panel, two side panels, a front panel and a rear panel. The cover member also includes a projection that extends downwardly from the top panel and through the central passageway of the sliding fastener to retain the soap system within the tray member while housed within said container.

13 Claims, 5 Drawing Sheets

FIG.1
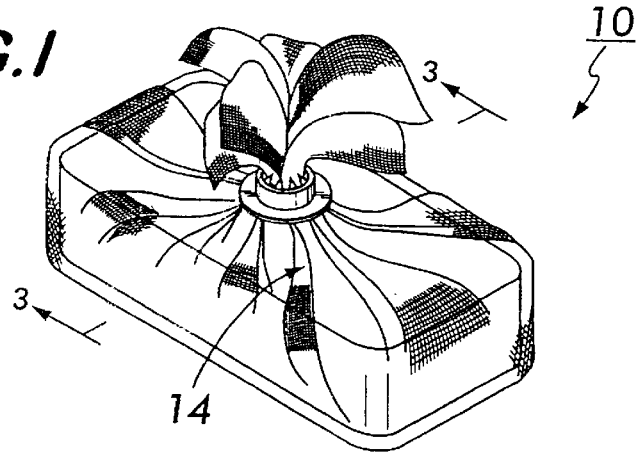
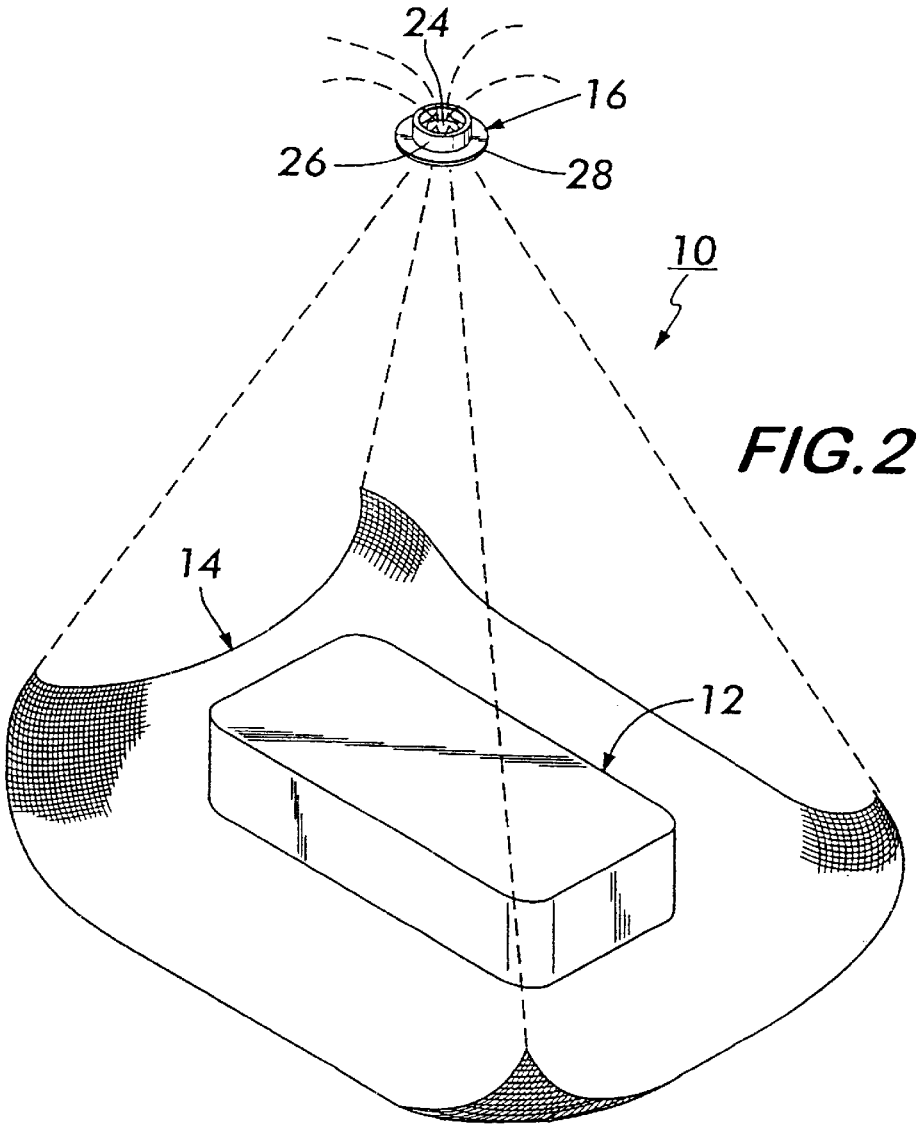
FIG.2

FIG. 6
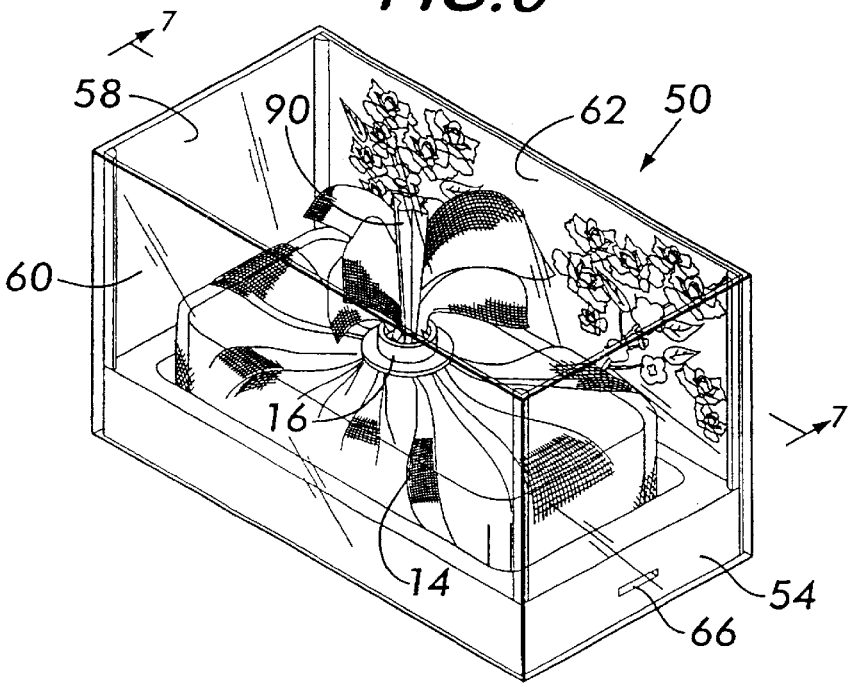
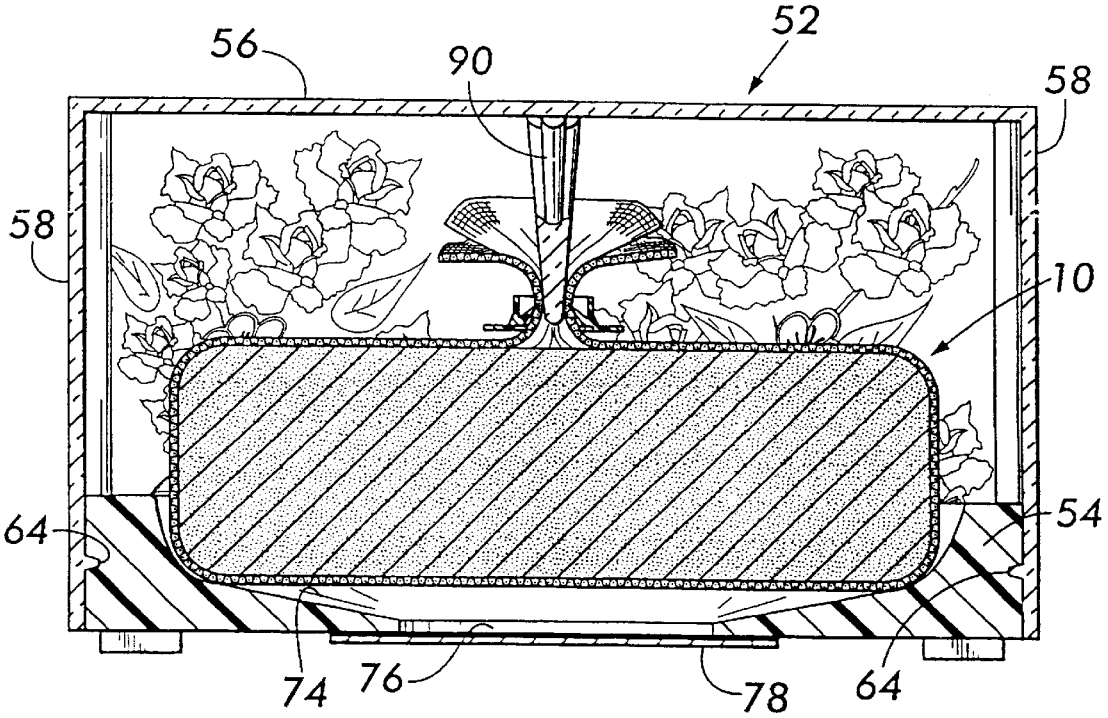
FIG. 7

CONTAINER FOR STORING AND DISPLAYING A SOAP SYSTEM

RELATED APPLICATIONS

This application is a continuation-in-part of U.S. application Ser. No. 09/543,137, filed on Apr. 5, 2000 (hereinafter "the '137 application") and claims priority under 35 U.S.C. §120 to the '137 application.

FIELD OF THE INVENTION

This invention relates generally to a container for storing and displaying a soap system for both soaping and scrubbing a person's body and more particularly to a storage and display container that employs a device for positioning the soap system within the container.

BACKGROUND OF THE INVENTION

Display containers, including those that are transparent, often serve to contain products during shipping and storage in addition to serving as a display piece to promote the sales of those products. The means by which products are displayed to the potential purchaser is an extremely important element in the marketing and perceived value of the products being sold. Expensive products can appear to be cheap if poorly displayed. Similarly, a less expensive product may have its perceived value substantially enhanced if it is well presented in a context of luxury and value. While the store environment is also an important element of the sales environment, the box or container which is the immediate visual and physical surrounding of the displayed product, is probably the most important portion of the sales environment.

Typically, many prior art display containers, including those that are transparent, are simple boxes that are sufficient in size for holding the product therein. However, these display containers do not take best advantage of preserving the product and presenting it for sale. For example, if the display container is also being utilized to house the product during shipping, the container could become marred or damaged as the result of movement of the product within the container during shipping. Likewise, the product itself could become damaged as the result of such movement. A damaged product or container will not provide an effective presentation from a sales standpoint. While the prior art display containers are adequate for basic storage purposes, they are not particularly well adapted for preserving products during shipping and storage and are not adequate for displaying such products in a commercial environment. Thus, it is desirable to provide a display container, such as one that is transparent, that retains the product at a fixed position and orientation within the container so as to minimize the potential for damage to the container or product held therein during shipping while providing a most advantageous presentation for sales purposes.

SUMMARY OF THE INVENTION

The above and other objects of this invention are provided by a container for storing and displaying a soap system. The soap system, which is arranged to be housed within the container, includes a bar of soap, a flexible, porous sheet retained around the bar of soap and a sliding fastener. The sliding fastener includes a peripheral wall that defines a central passageway therethrough. The sliding fastener is arranged for engaging a gathered end of the sheet extending through the central passageway thereof to retain the sheet about the bar of soap in a taut condition. The container includes a cover member arranged to fit together with a tray member. The cover member includes a projection that extends downwardly from the top panel and through the central passageway of the sliding fastener to retain the soap system within the tray member while the soap system is housed within the container.

In a variation of the first exemplary embodiment, the cover member includes a plurality of registration tabs extending inwardly therefrom and the tray member includes slots corresponding in number to the plurality of registration tabs. The slots are aligned with the plurality of tabs for engagement with the tabs for securement of the cover member to the tray member.

In another variation of the first exemplary embodiment, the cover member includes at least a top panel, two side panels, a front panel and a rear panel.

In another variation of the first exemplary embodiment, the internal dimensions of the slots correspond to the external dimensions of the registration tabs.

In another variation of the first exemplary embodiment, the cover member is transparent.

In another variation of the first exemplary embodiment, the container includes a retention means for retaining a card member that includes display indicia, the retention means comprising a pair of retention slots disposed adjacent opposite sides of the rear panel, the card member being sized to slide within the retention slots for positioning against the rear panel.

In another variation of the first exemplary embodiment, the top panel, side panels, front panel and rear panel of the cover member are molded together to form a one-piece construction.

In another variation of the first exemplary embodiment, the tray member includes a soap dish portion volumetrically contoured for receiving the soap system.

In another variation of the first exemplary embodiment, the soap dish portion additionally comprises an aperture located at the bottom thereof for allowing the drainage of soapy water from the soap system.

In another variation of the first exemplary embodiment, the tray member additionally comprises a plurality of corners, the container additionally comprising a plurality of feet, one located at each of the corners.

In another variation of the first exemplary embodiment, the container additionally comprising a strip arranged for releasable adhesive securement over the aperture.

In another variation of the first exemplary embodiment, the cover and tray members are formed of a plastic material.

Other objects and many attendant features of this invention will become readily appreciated as the same becomes better understood by reference to the following detailed description when considered in connection with the accompanying drawings.

BRIEF DESCRIPTION OF THE DRAWINGS

FIG. 1 is an isometric view of a soap system in accordance with this invention;

FIG.2 is an exploded isometric view of the soap system of this invention, schematically illustrating the manner in which the corners of the flexible sheet of the system are gathered and directed through the central opening of the sliding fastener of this invention;

FIG. 6 is an isometric view of a soap system in accordance with this invention stored within a display case of the present invention;

FIG. 7 is a section view taken along line 7—7 of FIG. 6;

DESCRIPTION OF THE PREFERRED EMBODIMENT

Figure 3:
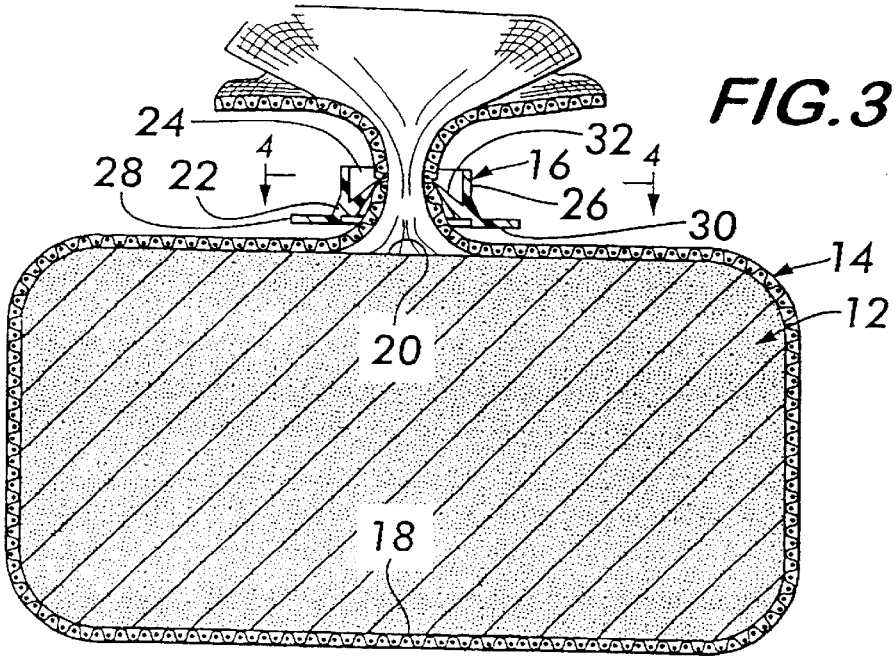
FIG. 3 is a sectional view taken along line 3—3 of FIG. 1.

A soap system employing the features of this invention is generally shown at 10 in FIGS. 1 and 2. As can be seen in FIGS. 1 and 2 the soap system 10 includes a bar of soap 12 and a flexible, porous sheet 14 which is retained around the bar of soap in a taut condition by a unique sliding fastener 16 of this invention.

The bar of soap 12 can be of any desired composition and shape and is shown in a rectangular shape herein solely for illustrative purposes. For example, the bar of soap can include lanolin and/or other skin treating components therein and can be of a variety of different shapes, including round, oval, elliptical, etc. Reference throughout this application to a "bar of soap" or "soap bar" should be given its broadest interpretation.

The flexible, porous sheet 14 can be of any desired material that preferably will not disintegrate during the life of the product. Most preferable the flexible, porous sheet is made of a porous plastic material, such as Nylon, and has mildly abrasive properties so that it will provide an effective scrubbing action on a person's skin. One plastic material which has been found well suited for use in this invention is porous plastic web material employed as bridal tulle. Although a preferred polymer employed in the flexible, porous sheet is Nylon, it should be understood that this invention is not limited to the use of any particular plastic or polymer composition. As long as the sheet material is sufficiently porous to permit an effective amount of the soap to be metered therethrough in use, and is capable of providing a desired, mildly abrasive action against the person's skin without deteriorating in use, such a sheet material is satisfactory for use in the present invention.

Referring specifically to FIG. 2, it should be noted that the soap system 10 of this invention is constructed by placing the bar of soap 12 generally in the center of the flexible, porous sheet 14, and then gathering the ends of the sheet together and directing the ends through the unique sliding fastener 16 of this invention. As can be seen best in FIGS. 1 and 3, when the gathered ends are directed through the fastener 16 so as to position the fastener close to the surface of the bar of soap 12, the porous sheet 14 is maintained in a generally taut condition about the periphery of the bar of soap. In particular, it should be noted that the porous sheet 14 is maintained taut against inner surface 18 of the bar of soap, and it is this surface that is predominately utilized to engage a person's skin to provide the desired body washing and scrubbing action.

Reference throughout this application to "inner" or "inward" in identifying an orientation, position, or direction of movement, is relative to a person's skin. In other words, the surface 18 of the bar of soap is referred to herein as the inner surface of the bar of soap, and the movement of the sliding fastener 16 toward the bar of soap is movement in an inward direction. Correspondently, the sliding fastener 16 is located closely adjacent an outer surface 20 of the bar of soap 12, i.e., that surface opposed to inner surface 18.

Figure 4:
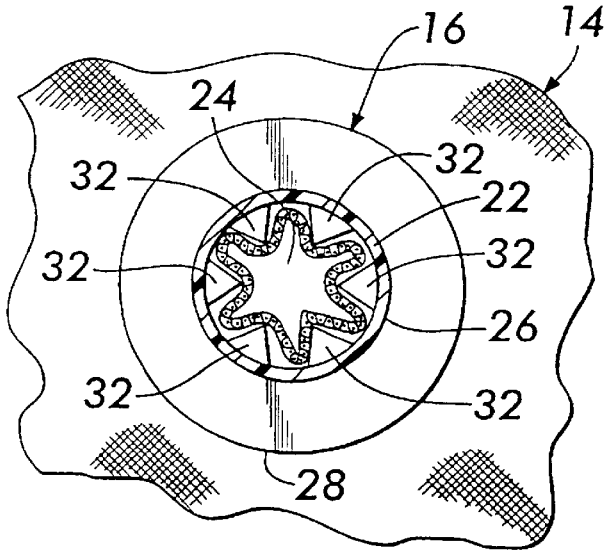
FIG. 4 is a section view taken along line 4—4 of FIG. 3.
Figure 5:
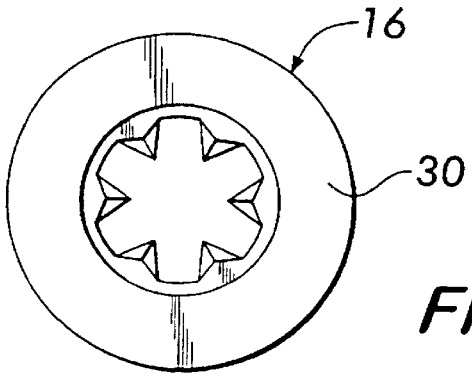
FIG. 5 is a bottom view of the fastener of this invention showing details of construction of the locking member.

Referring to FIGS. 3 through 5, the sliding fastener 16 of this invention preferable is an injection molded plastic member including a hollow body 22 providing a central passageway 24 therein. The hollow body 22 includes an outer, central hub section 26 and an inner, flange 28 that extends beyond the periphery of the hub 16 and includes a generally flat inner surface 30.

As can be seen best in FIGS. 3 through 5, a plurality of sheet locking members 32 are disposed in the central passageway 24, and are angled toward the center of the passageway 24 in an outward direction.

The locking members 32 preferably are injection molded as an integral part of the sliding fastener 16 and the outer edges thereof are pointed so as to engage the periphery of the gathered end of the flexible sheet 14. Due to the orientation of the locking members 32, the sliding fastener 16 is capable of freely moving, or sliding, in an inward direction toward the outer surface 20 of the bar of soap. However, due to the outwardly angled orientation of the locking members 32, movement of the sliding fastener 16 in an outward direction, away from the bar of soap, is precluded. Specifically, the locking members 32 will dig into the flexible, porous sheet 14 to preclude such outward movement. Thus, the sliding fastener 16 is a "one-way" device; capable of movement only in a direction to continuously foreshorten the sheet 14 about the bar of soap 12, to thereby maintain the sheet in a taut condition as the soap is being dissipated during continuous use.

It should be apparent that the gathered end of the sheet material 14 extending through the sliding fastener 16 provides a convenient gripping area for a person using the soap device, thereby permitting the device to be easily gripped to wash and scrub a person's body even when the bar of soap 12 is almost completely dissipated.

It also should be noted that the flexible sheet 14, by virtue of being maintained taut about the bar of soap, aids in retaining the general configuration of the bar of soap, even when the bar of soap is wet.

A further benefit of this invention is that the flexible, porous sheet material effectively meters smaller quantities of soap through the porous sheet than otherwise would be applied to a person's skin if the bar of soap were being utilized in an unconfined manner. Accordingly, it is believed that the bar of soap 12 employed in the soap system of this invention will have a greater useful life than if the bar of soap were used in a conventional manner, without being confined in any flexible, porous retaining sheet.

It should be understood that various modifications can be made within the scope of this invention, the embodiments described herein being presented solely for purposes of illustrating the best mode contemplated by the inventor for carrying out the invention.

For example, although the preferred embodiment of this invention includes a unique sliding fastener 16 to continuously maintain the flexible, porous sheet taut about the bar of soap 12, in accordance with the broadest aspects of this invention other fastening means can be employed. In fact, in accordance with the broadest aspects of this invention, the fastening means does not necessarily need to be a sliding fastening means, e.g., it could be a conventional, flexible band either twisted or tied about the gathered end of the flexible, porous sheet 14. However, in accordance with the most preferred embodiment of this invention, a sliding fastener clearly is desirable, since it permits the easy and continuous adjustment of the flexible, porous sheet 14 about the bar of soap 12 as the bar of soap is being dissipated.

Referring now to FIGS. 6 and 7, the soap system 10 of the present invention is shown as being disposed within a box-shaped container 50 (FIG. 6) that includes a cover member 52 (FIG. 7) and a tray member 54. The cover member 52 includes a top panel 56, two side panels 58, a front panel 60 and a rear panel 62 positioned rearwards of the front panel 60. The panels 56, 58, 60 and 62 may be formed as an integral one-piece construction such as by injection molding of any suitable plastic material. Alternatively, the panels 56, 58, 60 and 62 may be fabricated individually and then joined to one another to form the cover member 52. Although under the preferred exemplary embodiment of this invention the cover member 52 includes panels 56, 58, 60 and 62 to form a box shape, it is within the scope of this invention for the container to employ a greater or fewer number of panels to obtain shapes other than a box shape, e.g., triangular, hexagonal, circular, etc. Moreover, the top panel 56 could be eliminated and the container could be pyramidal in shape comprising a plurality of triangular side panels. Under the preferred exemplary embodiment, the panels are transparent to enable one to see therethrough to the soap system 10 located therein.

Figure 8:
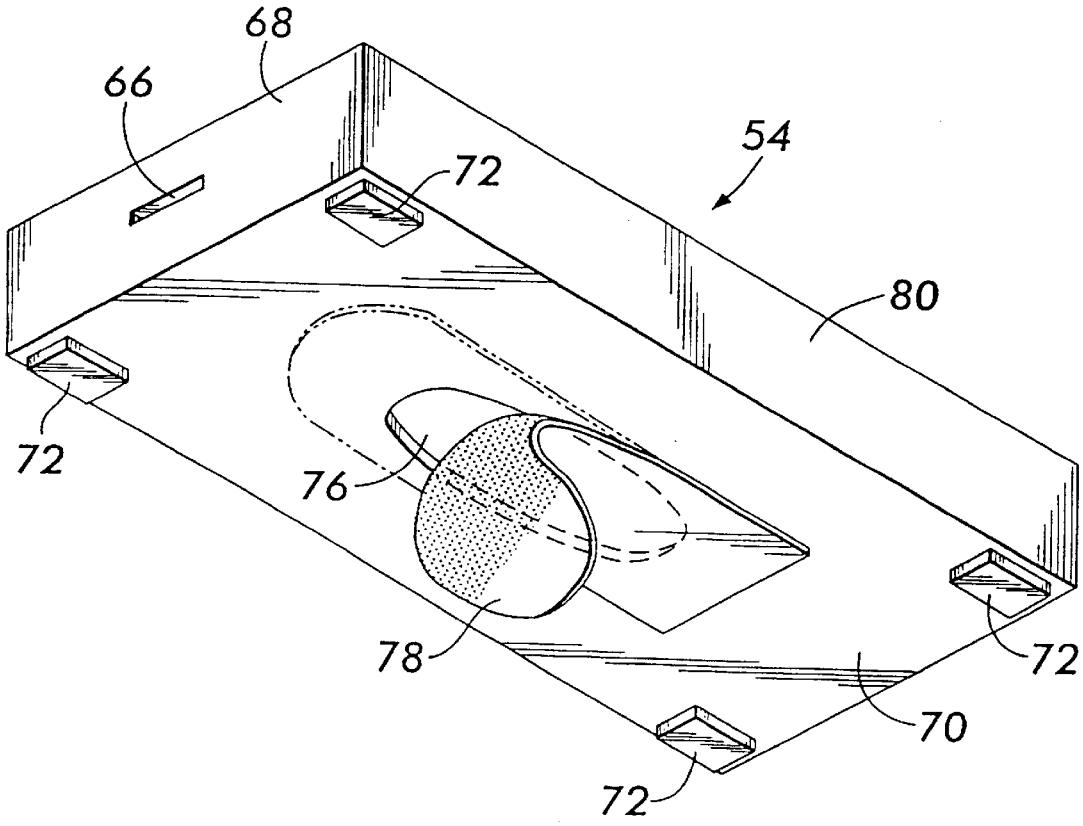
FIG. 8 is an isometric view of the tray portion of the display case of the present invention; and, FIG. 9 is an exploded isometric view of the display case of the present invention and the soap system stored therein.

As best shown in FIG. 7, the cover member includes a plurality of inwardly extending registration tabs 64 that are located at the bottom center of the inside surface of side panels 58. The registration tabs 64 are arranged for engagement with a plurality of aligned through slots 66, one of which is best shown in FIG. 8. The slots 66 are located on side walls 68 of the tray member 54. The internal dimensions of the through slots 66 correspond to the external dimensions of the registration tabs 64. Alternatively, the registration tabs 64 could be located on the inside surface of the front and rear panels, 60 and 62, and aligned for engagement with a plurality of through slots 66 located on the front wall 80 (FIG. 8) and rear wall of the tray member 54. Alternatively, the registration tabs could be located on the outside surface of the front and rear walls of the tray member 54 and arranged for engagement with a plurality of through slots located on the front and rear panels, 60 and 62, of the cover member 52. Together, the cover member 52 and tray member 54 serve for housing the soap system 10 of the present invention for display such as at a point of sale or for safely storing the soap system 10 during shipping. The cover member 52 is removable from the tray member 54 to obtain access to the soap system 10.

Referring again to FIG. 8, the tray member 54 includes a bottom wall 70, the lower surface of which includes a plurality of feet 72 disposed thereon by any suitable means, e.g., adhesive. Although in FIG. 8, the feet 72 are depicted as located at the corners of the bottom wall 70, it should understood that these feet could be located elsewhere along the bottom wall 70 of the tray 54 without departing from the scope of this invention. Moreover, a greater or fewer number of feet 70 could be provided on the bottom wall 70 without departing from the scope of this invention. Moreover, although the feet 72 are illustrated as being square in shape, they could be of any other suitable shape, e.g., circular, rectangular, etc.

Figure 9:
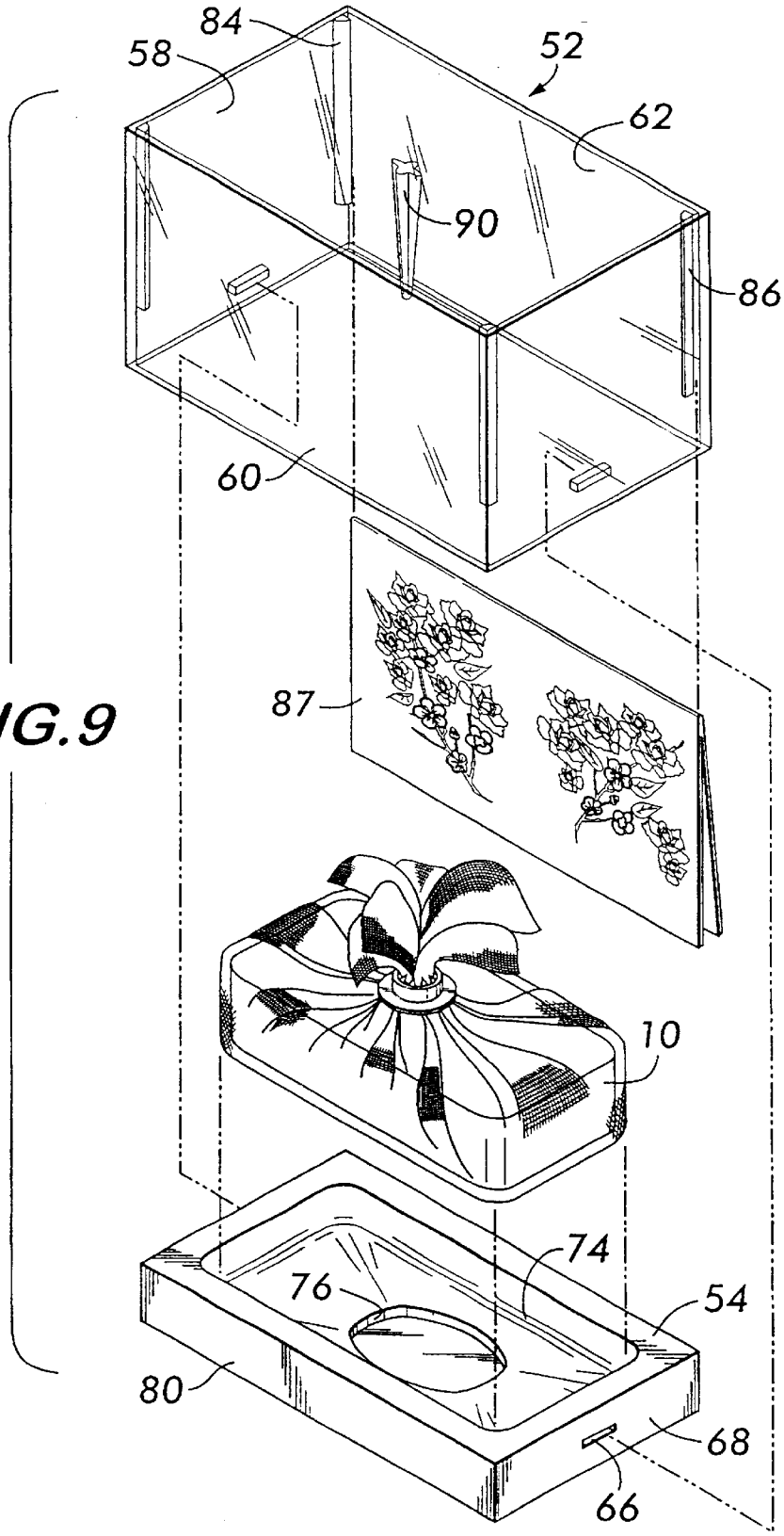

The tray member 54 is arranged to be utilized as a soap dish for storing the soap system 10 after use and re-use. Referring now to FIG. 7, the tray member 54 includes a downwardly sloping soap dish portion 74 that is volumetrically contoured for receiving the soap system 10 of the present invention therein. As best shown in FIG. 9, centered at the bottom of the soap dish portion 74 is a large drainage aperture 76 that serves to drain any soapy water that may remain on the soap system 10 after use. As best shown in FIG. 8, a strip of adhesive 78 is used for covering the drainage aperture 76 to preserve the contents of the soap system 10 during display and shipping of the soap system 10. Prior to use of the soap system 10, the strip of adhesive 78 may be removed from the tray member 54 to expose the drainage aperture 76 thus allowing any soapy water that may remain on the soap system after use to drain through the aperture 76 to avoid any soap scum buildup.

Referring now to FIGS. 6 and 9, each side panel 58 includes a vertically oriented rib 84, 86 located on the inside wall thereof in close proximity with the rear panel 62. A vertical slot is defined between each vertically oriented rib 84, 86 and the rear panel 62. The vertical slots are arranged for slidingly receiving and positioning against the rear panel 62 a card or other suitable paper stock 87 on which display indicia is located. Under the preferred embodiment, the paper stock 87 is approximately the width of the rear panel 62 and when folded in half, as shown in FIG. 9, is approximately the height of the rear panel 62. The display indicia may be a colorful and decorative pattern or design such as a floral design for sales, advertising or other purposes.

Referring now to FIGS. 6 and 7, a vertical member 90 is shown extending downwardly for a fixed distance from the top panel 56. When packaging the soap system 10 of the present invention, the soap system 10 is placed centrally within the soap dish portion 74 of the tray member 54 with the sliding fastener 16 situated centrally on the top of the bar of soap 12. Next, the cover member 52 is placed over the tray member 54 with the vertical member 90 extending downwardly through the central passageway 24 of the sliding fastener 16. Specifically, as best shown in FIG. 7, the vertical member 90 extends downwardly within the central hub section 26 of the fastener 16 and within the flexible sheet 14 gathered therein but does not extend so far as to actually touch the bar of soap 12. Although under the preferred exemplary embodiment of this invention the vertical member 90 is shown as not touching the bar of soap 12, it is within the scope of this invention for the vertical member 90 to touch the bar of soap 12, or if desired, to penetrate the surface of the bar of soap 12 by a small distance, e.g., one eighth of an inch. In this manner, the vertical member 90 secures the position and orientation of the soap system 10 within the container 50 for shipping and display. The inwardly extending registration tabs 64 located on the cover member 50 extend through the slots 66 located on the tray 54 to secure the cover member 50 to the tray member 54. In the preferred embodiment, in cross-section, the vertical member 90 includes a plurality of outwardly extending ribs that are arranged to fit between the plurality of sheet locking members 32 disposed in the central passageway 24.

Without further elaboration, the foregoing will so fully illustrate my invention that others may, by applying current or future knowledge, readily adopt the same for use under various conditions of service.

I claim:

1. A container for storing and displaying a soap system, the soap system including a bar of soap, a flexible, porous sheet retained around the bar of soap and a sliding fastener having a peripheral wall defining a central passageway therethrough, the sliding fastener arranged for engaging a gathered end of the sheet extending through the central passageway thereof to retain the sheet about the bar of soap in a taut condition, said container comprising:

a. a cover member;

b. a tray member arranged to fit together with said cover member to define a space for housing said soap system; and, c. a projection extending downwardly from said cover member and arranged for passage into the central passageway of the sliding fastener to retain the soap system within said tray member while the soap system is housed within said container.

2. The container of claim 1 wherein said cover member includes a plurality of registration tabs extending inwardly from said cover member and wherein said tray member includes slots corresponding in number to said plurality of registration tabs, said slots being aligned with said plurality of tabs for engagement therewith for securement of said cover member to said tray member.

3. The container of claim 2 wherein the internal dimensions of said slots correspond to the external dimensions of said registration tabs.

4. The container of claim 1 wherein said cover member is transparent.

5. The container of claim 1 further comprising retention means for retaining a card member that includes display indicia.

6. The container of claim 5 wherein said retention means comprises a pair of linearly aligned retention slots disposed adjacent opposite sides of said rear panel, said card member being sized to slide within said retention slots for positioning against said rear panel.

7. The container of claim 1 wherein a top panel, side panels, a front panel and rear panel of said cover member are molded together to form a one-piece construction.

8. The container of claim 1 wherein said tray member includes a soap dish portion volumetrically contoured for receiving the soap system.

9. The container of claim 8 wherein said soap dish portion additionally comprises an aperture located at the bottom thereof for allowing the drainage of water from the soap system.

10. The container of claim 9 additionally comprising a strip arranged for releasable adhesive securement over said aperture.

11. The container of claim 1 wherein said tray member additionally comprises a plurality of corners, said container additionally comprising a plurality of feet, one located at each of said corners.

12. The container of claim 1 wherein said cover member and said tray member are formed of a plastic material.

13. The container of claim 1 wherein said cover member comprises at least a top panel, two side panels, a front panel and a rear panel positioned rearwards of said front panel.

* * * * *